US007421952B2

(12) United States Patent
Taylor

(10) Patent No.: US 7,421,952 B2
(45) Date of Patent: Sep. 9, 2008

(54) TRACK/RIGHT OF WAY MAINTENANCE AND REPAIR SYSTEM

(76) Inventor: Timothy Charles Taylor, 2440 Sandy Plains Rd., Bldg. 25, Suite 100, Marietta, GA (US) 30066

( * ) Notice: Subject to any disclaimer, the term of this patent is extended or adjusted under 35 U.S.C. 154(b) by 208 days.

(21) Appl. No.: 11/137,274

(22) Filed: May 25, 2005

(65) Prior Publication Data

US 2006/0266251 A1 Nov. 30, 2006

(51) Int. Cl.
*E01B 29/05* (2006.01)

(52) U.S. Cl. ..... 104/2; 105/456

(58) Field of Classification Search ..... 105/264; 104/2; 108/56, 49; 414/390, 391, 393, 680, 414/686, 687; 37/411, 433; 188/52, 56, 188/33

See application file for complete search history.

(56) References Cited

U.S. PATENT DOCUMENTS 1,433,009 A * 10/1922 Hildebrandt ..... 105/264
2,266,701 A * 12/1941 Baseit ..... 188/56
2,368,517 A * 1/1945 Brimble ..... 188/170
3,062,386 A * 11/1962 Johnson ..... 212/303
3,348,624 A * 10/1967 Just et al. ..... 180/305
4,504,185 A * 3/1985 Yagyu et al. ..... 414/700
4,741,072 A 5/1988 Wilkerson
4,938,239 A 7/1990 Theurer et al.
4,991,673 A * 2/1991 Ericsson ..... 180/41
5,100,278 A * 3/1992 Westlake ..... 414/339
5,163,570 A * 11/1992 Mundis et al. ..... 212/278
6,148,732 A 11/2000 Conway et al.
6,491,352 B2 * 12/2002 Engle ..... 303/8

* cited by examiner

*Primary Examiner*—Mark T Le
(74) *Attorney, Agent, or Firm*—Erickson, Kernell, Derusseau & Kleypas, LLC

(57) ABSTRACT

A track/right of way maintenance and repair system including a loader car, implement car and refuse car for removal, pickup and transport of debris found along a railroad track. The loader car is hydraulically powered along the track and includes a hydraulic rotatable and pivotal segmented boom for releasably collecting debris, utilizing various implements as stored in the implement car. An operator cab is rotatable with the boom to allow for unobstructed viewing and is pivotal between functional and reduced profile positions to allow the loader car to pass underneath bridges, viaducts or the like. A hydraulic reservoir enables the system to be self powered including hydraulic motor propulsion, boom rotation, boom pivot and braking, cab tilt and implement power. The system allows for an efficient, contemporaneous debris removal, storage and transport to a dump site by one crew.

22 Claims, 21 Drawing Sheets

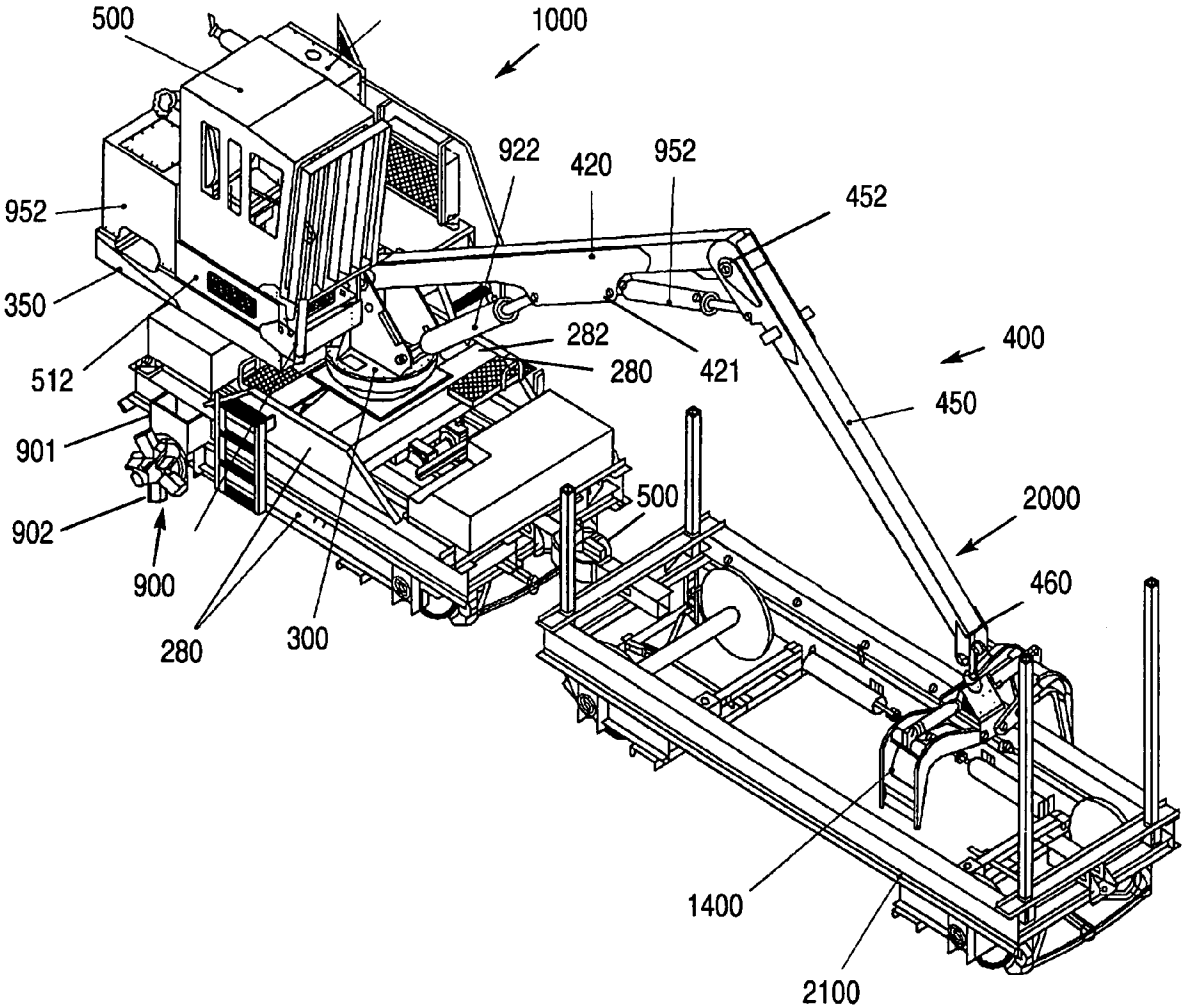
FIGURE #1

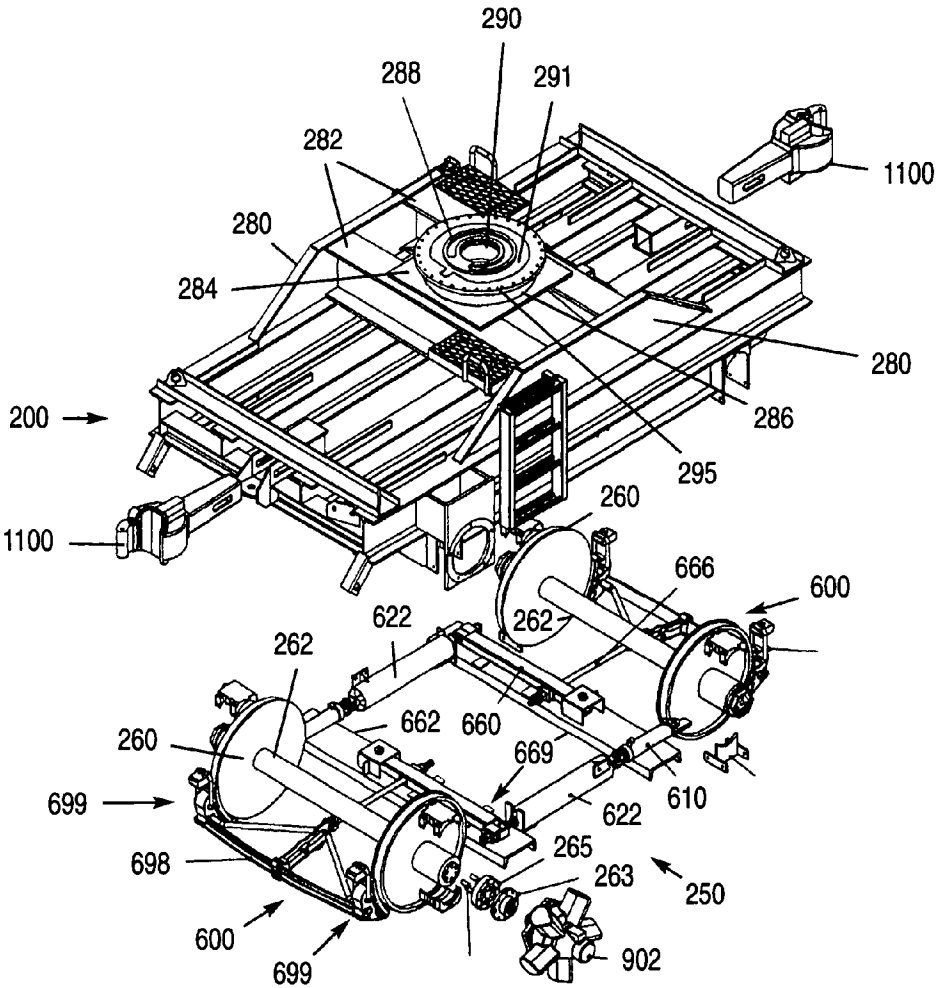
FIGURE #2

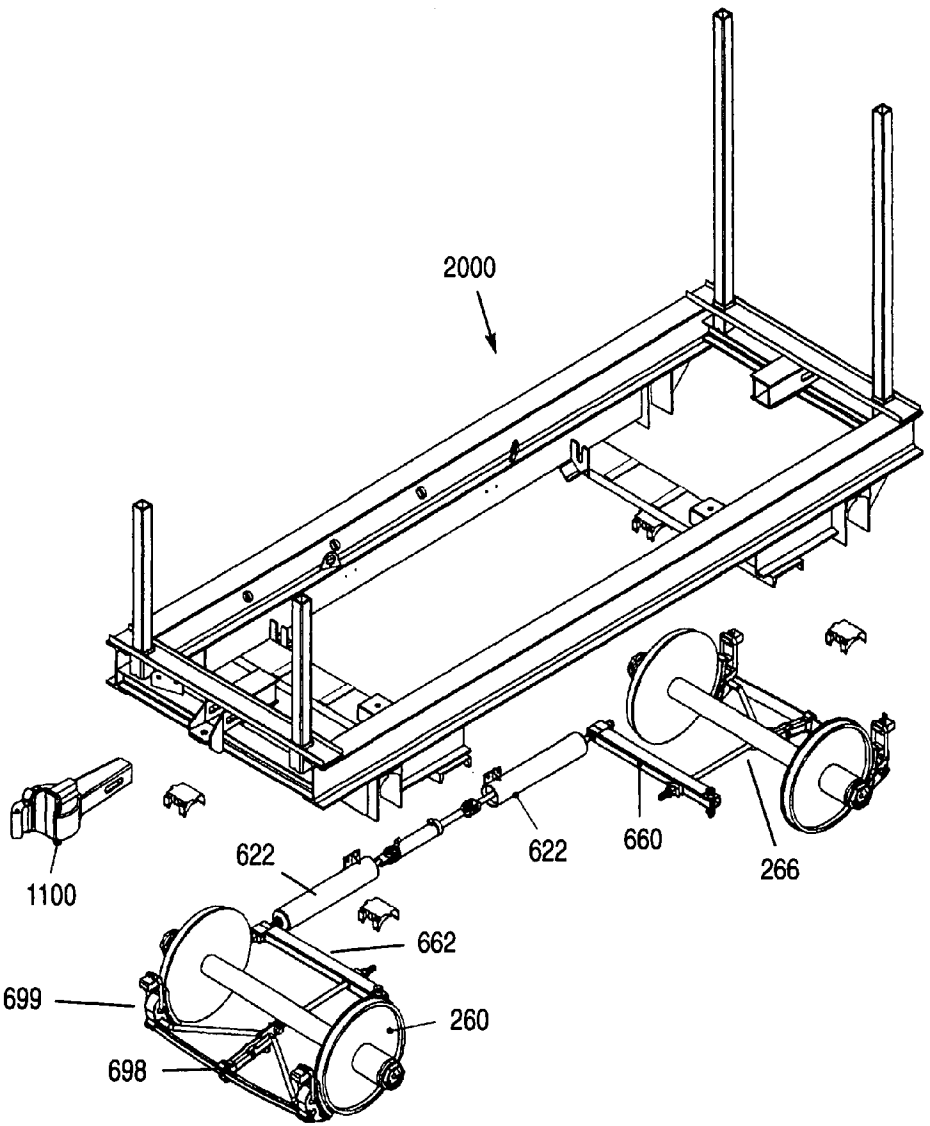
FIGURE #3

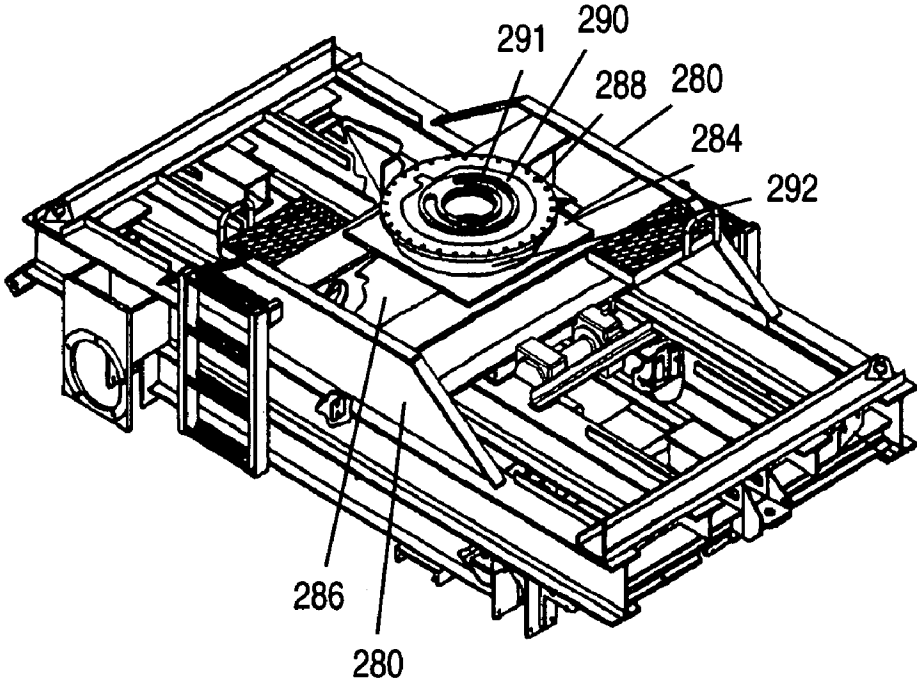
FIGURE #4

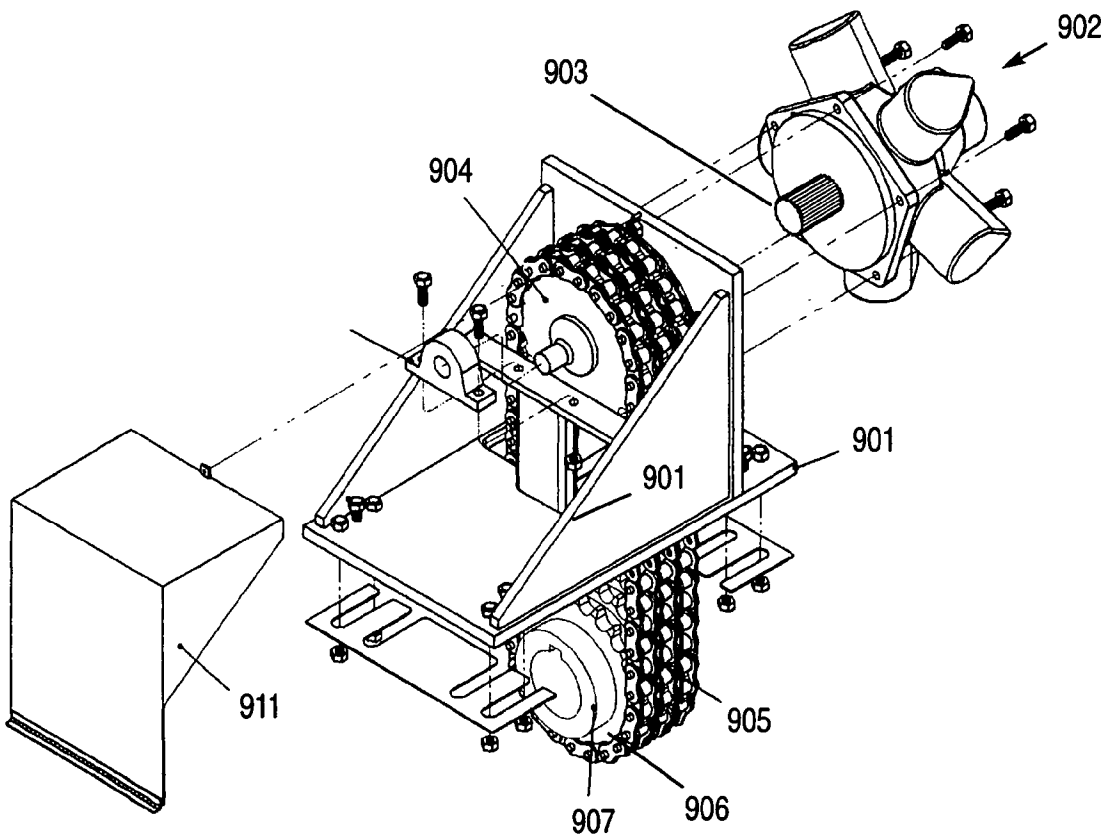
FIGURE #5

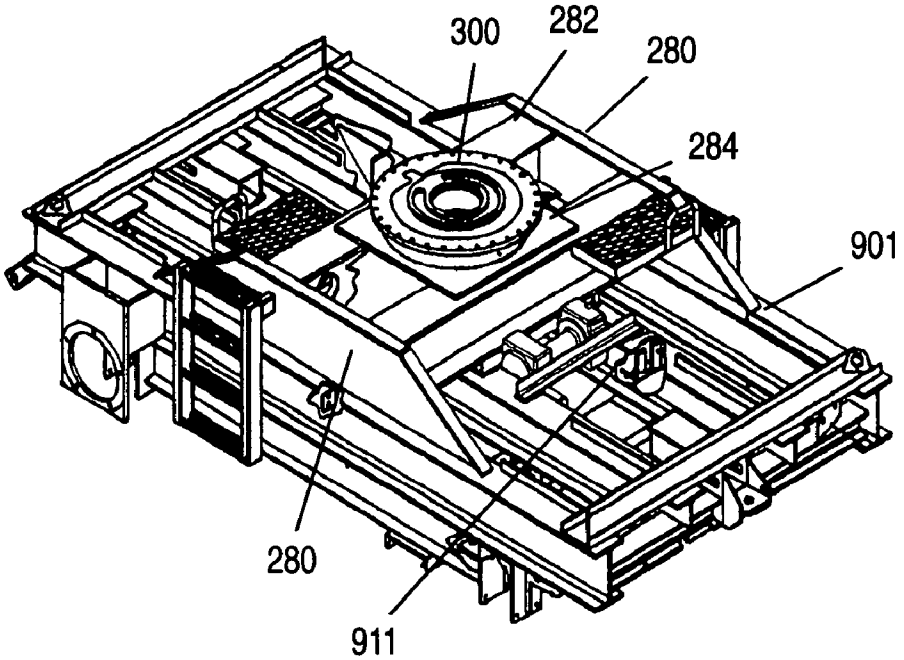
FIGURE #5A

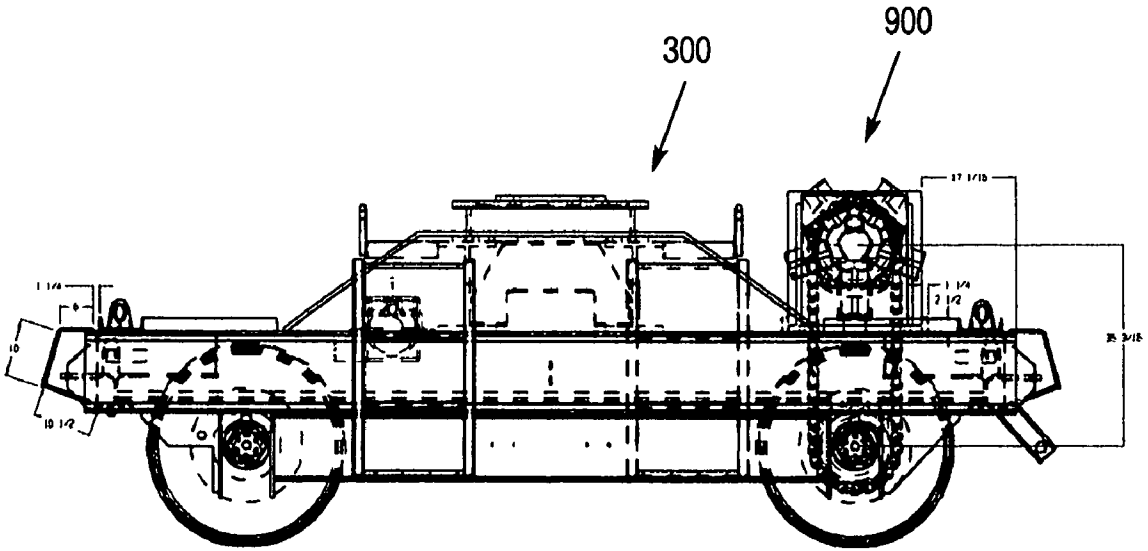
FIGURE #6

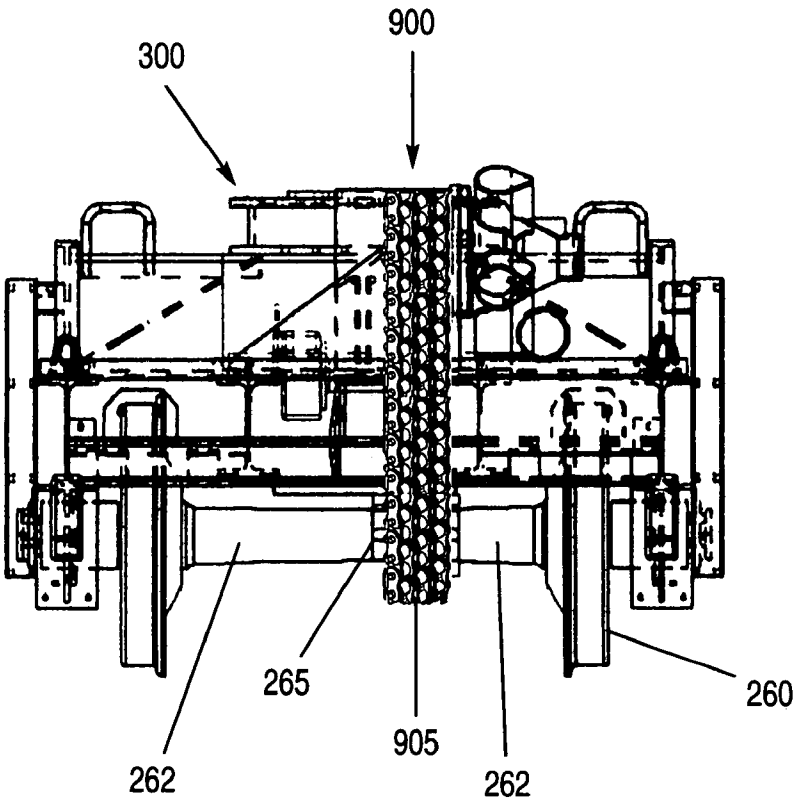
FIGURE #7

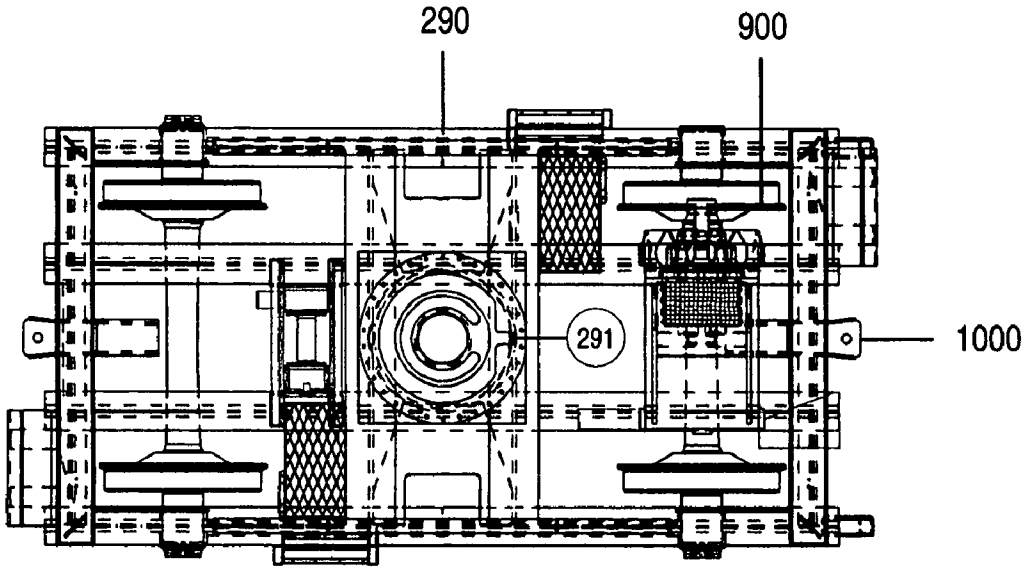
FIGURE #8

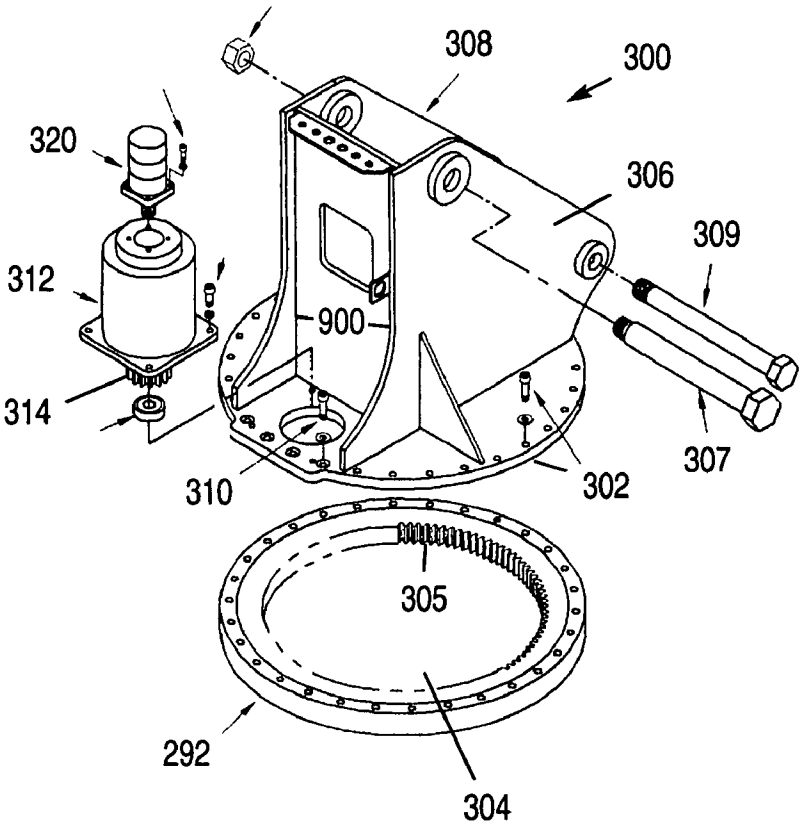
FIGURE #9

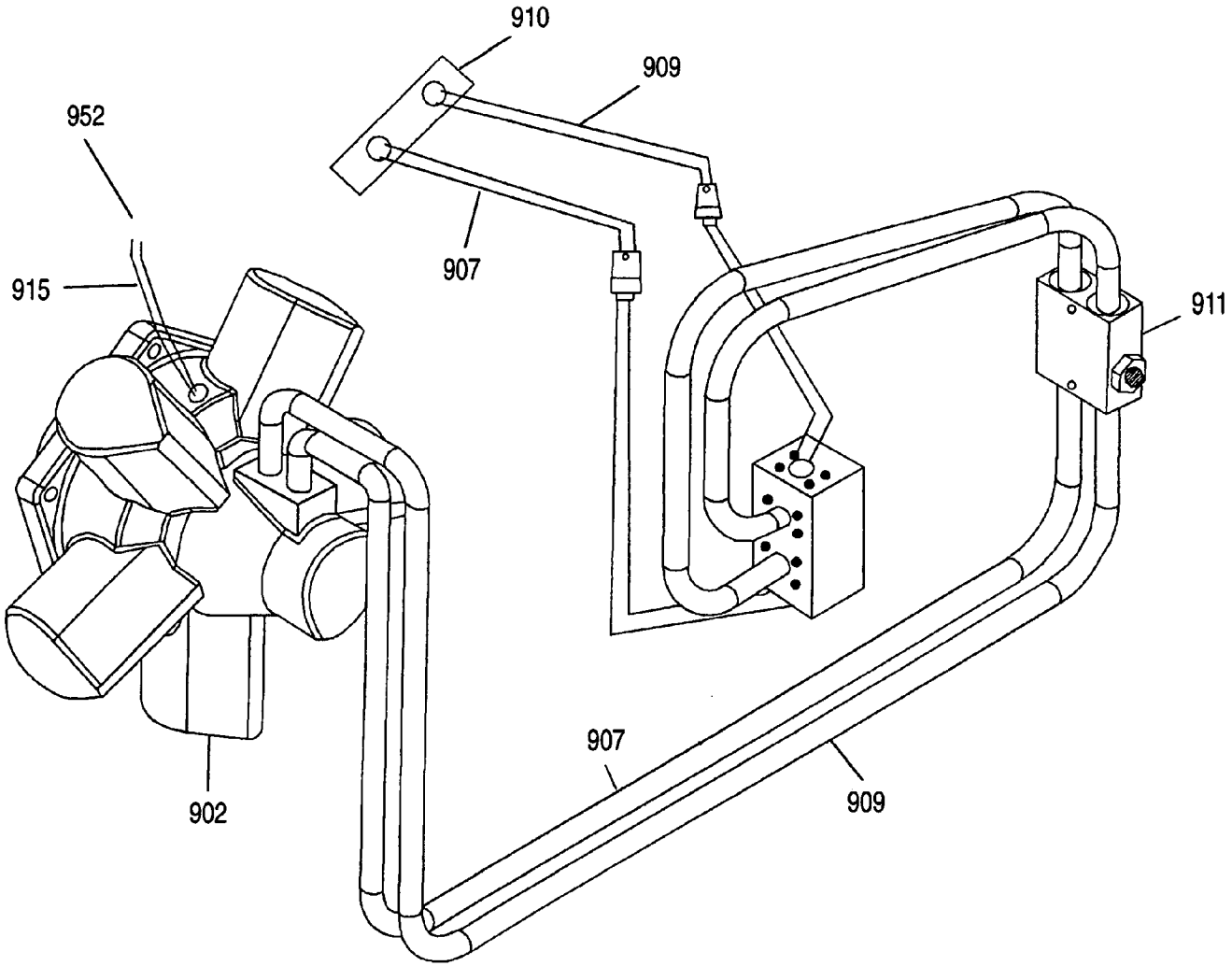
FIGURE #10

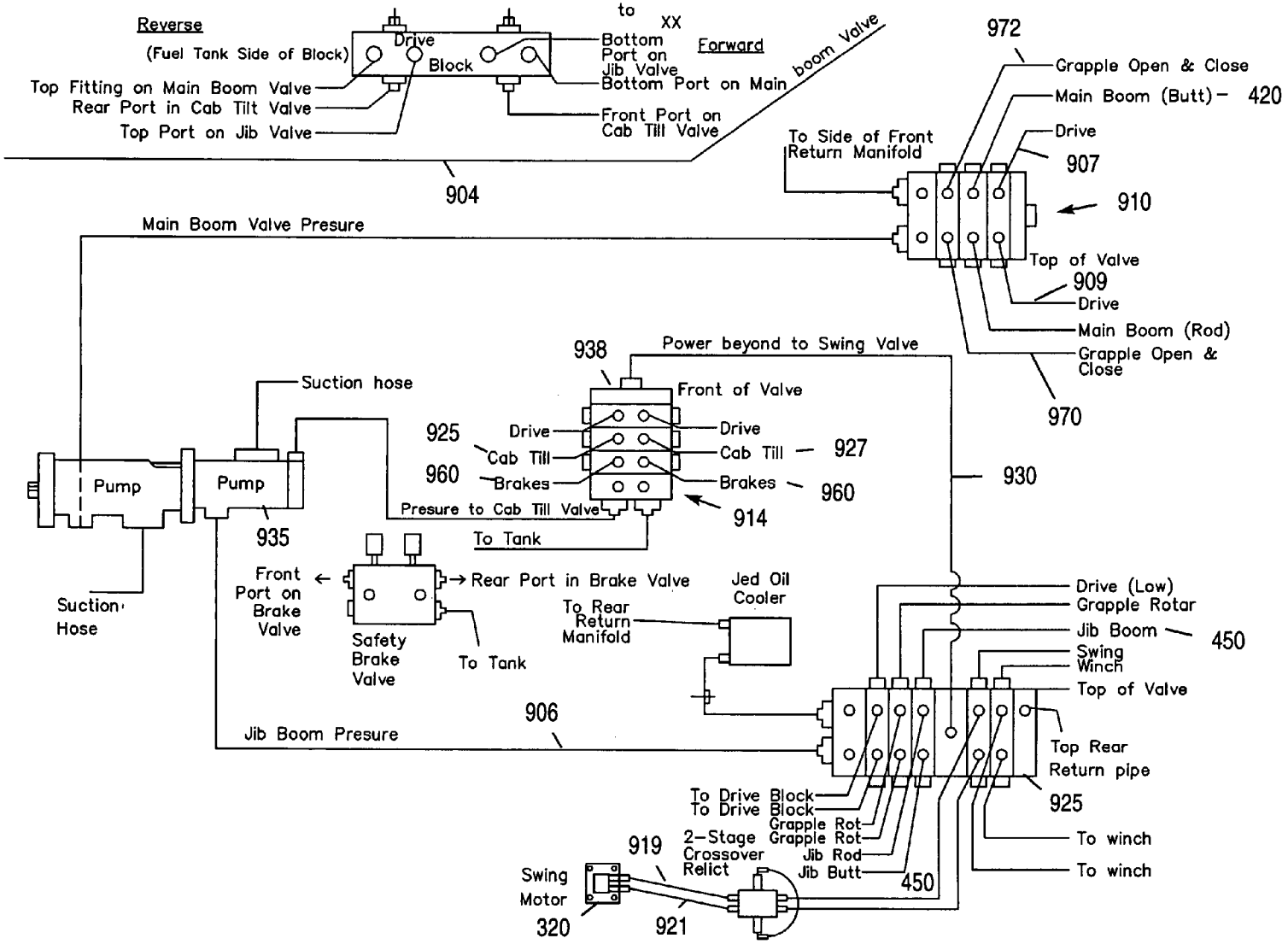
FIGURE #11

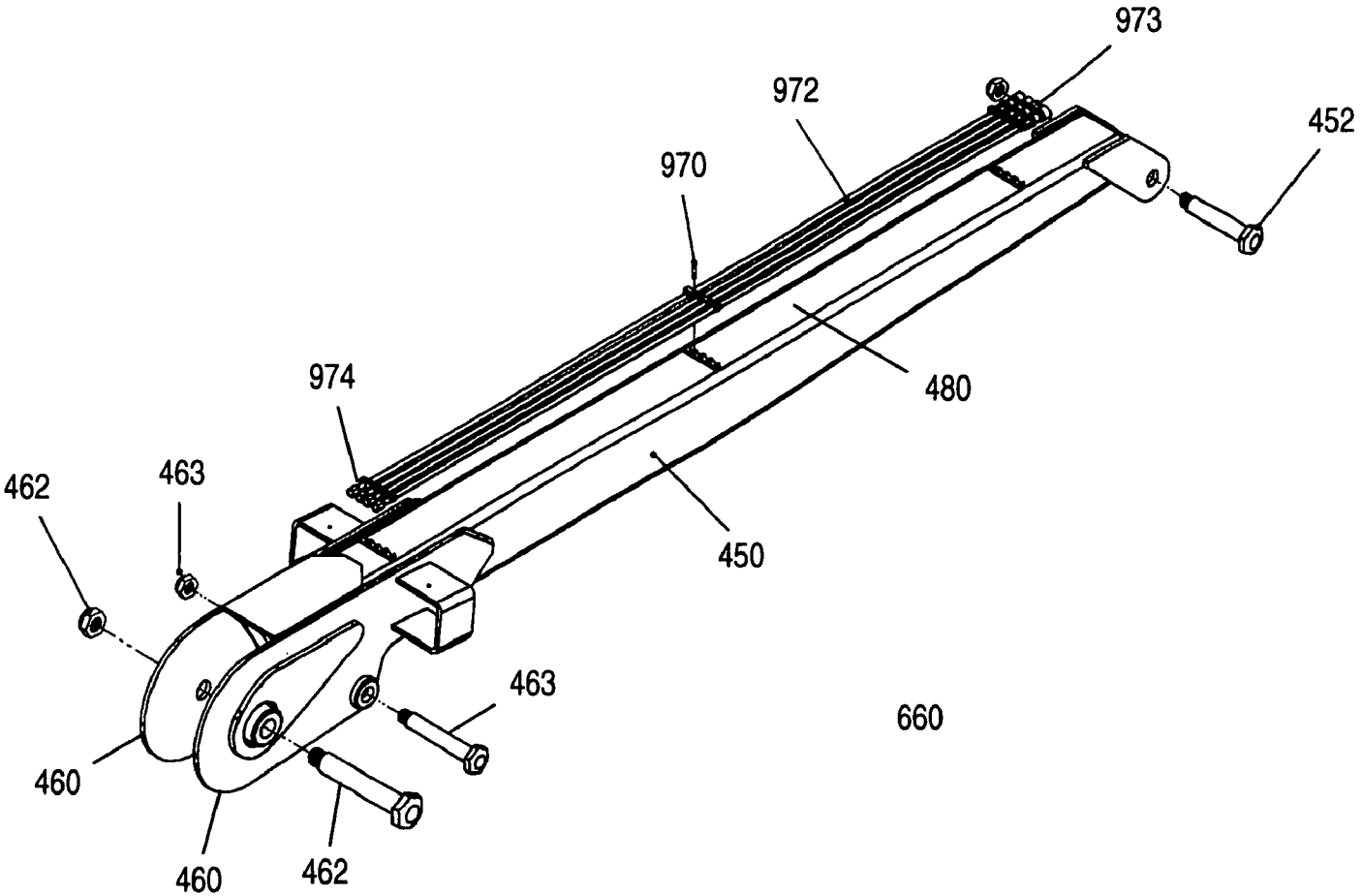
FIGURE #12

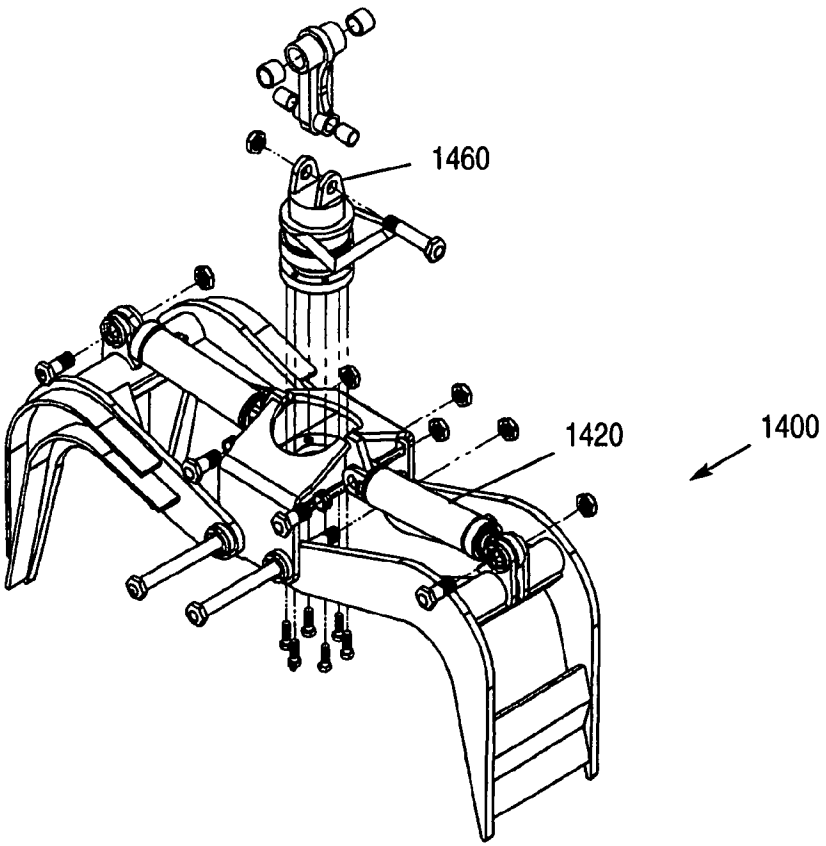
FIGURE #13

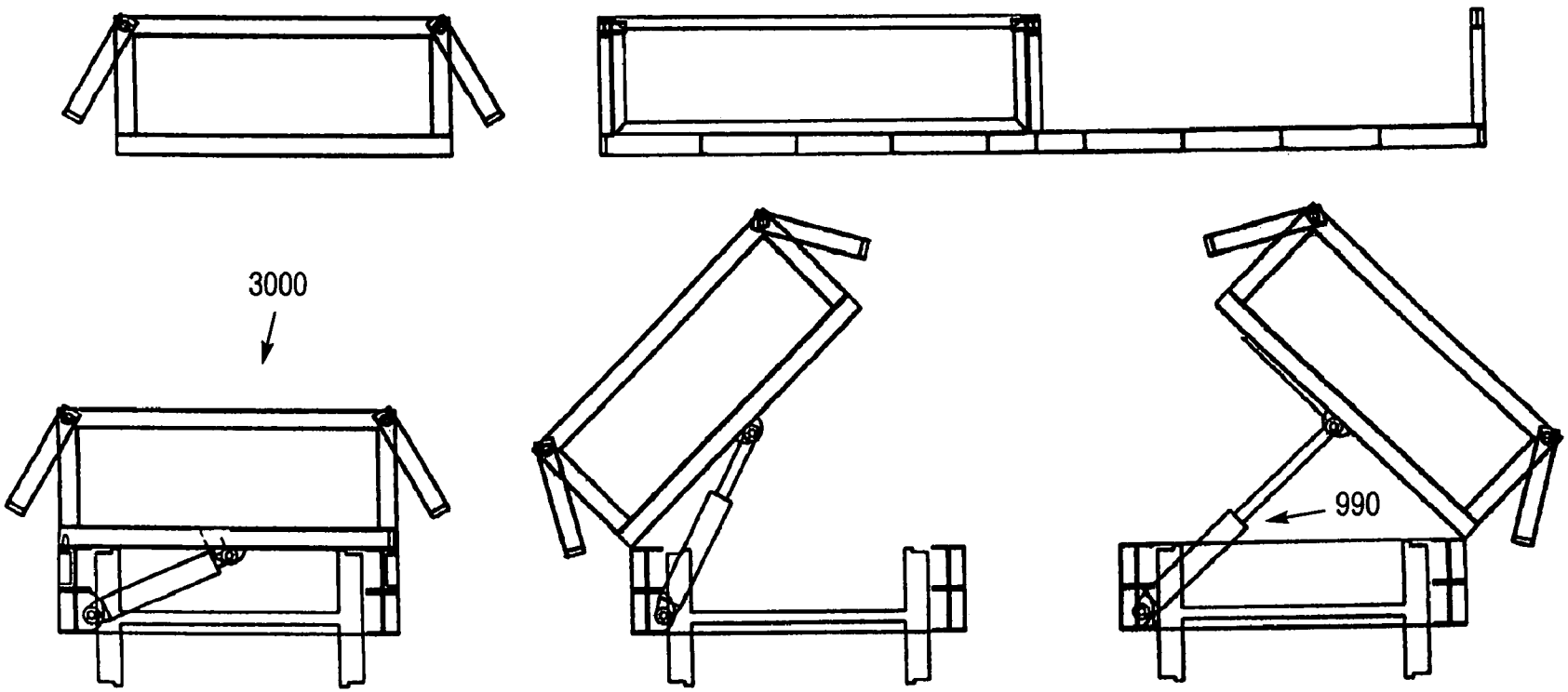
FIGURE #14

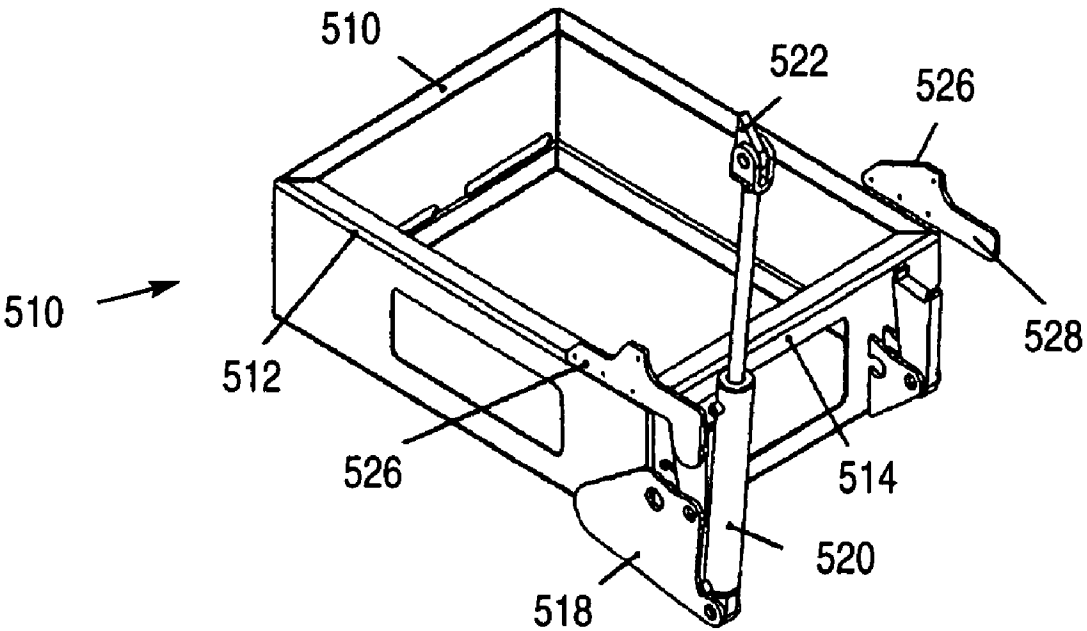
FIGURE #15

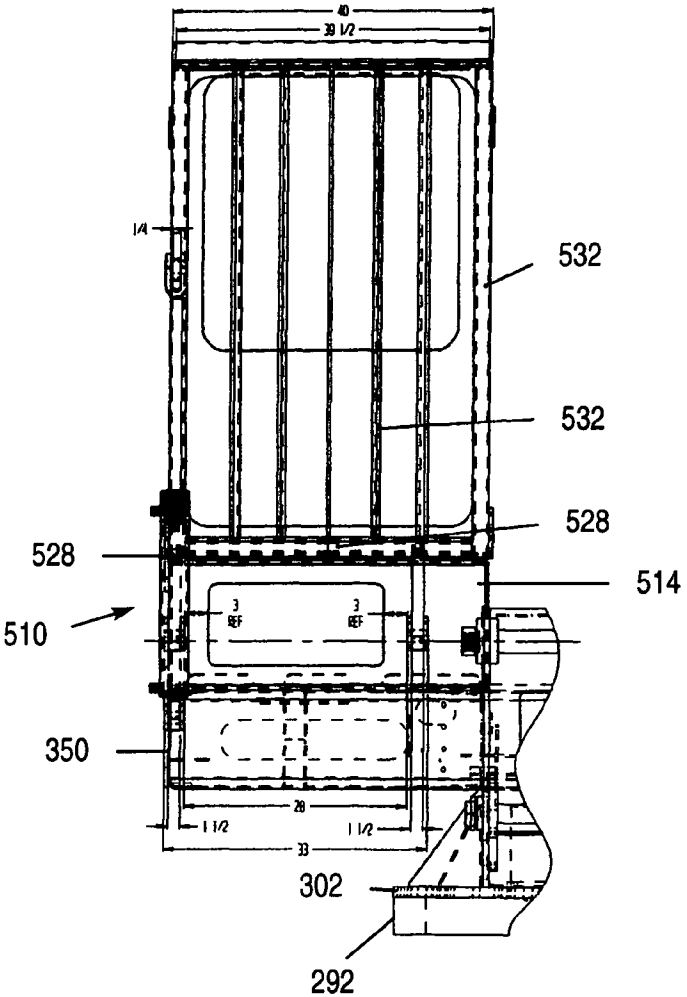
FIGURE #16

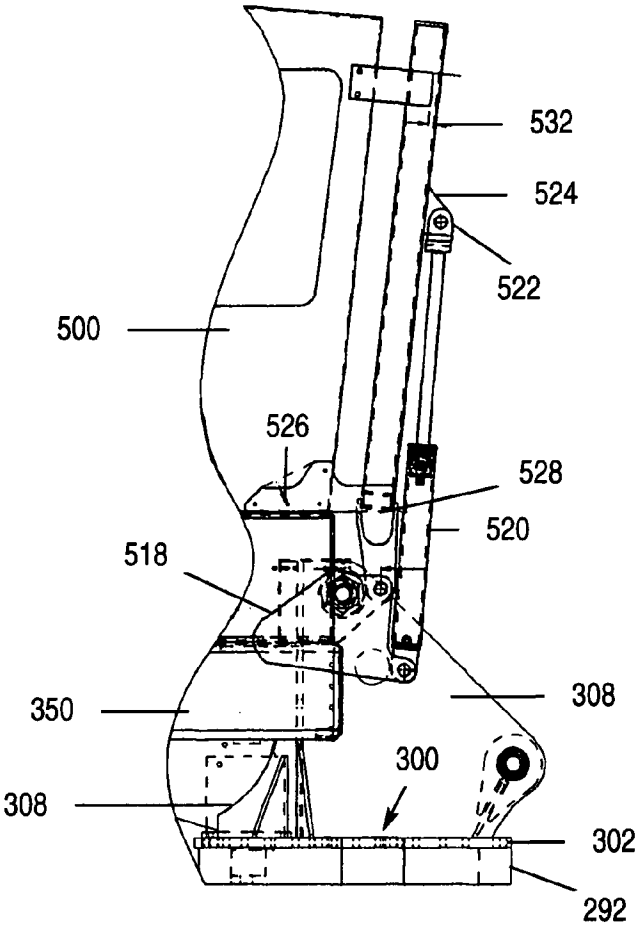
FIGURE #17

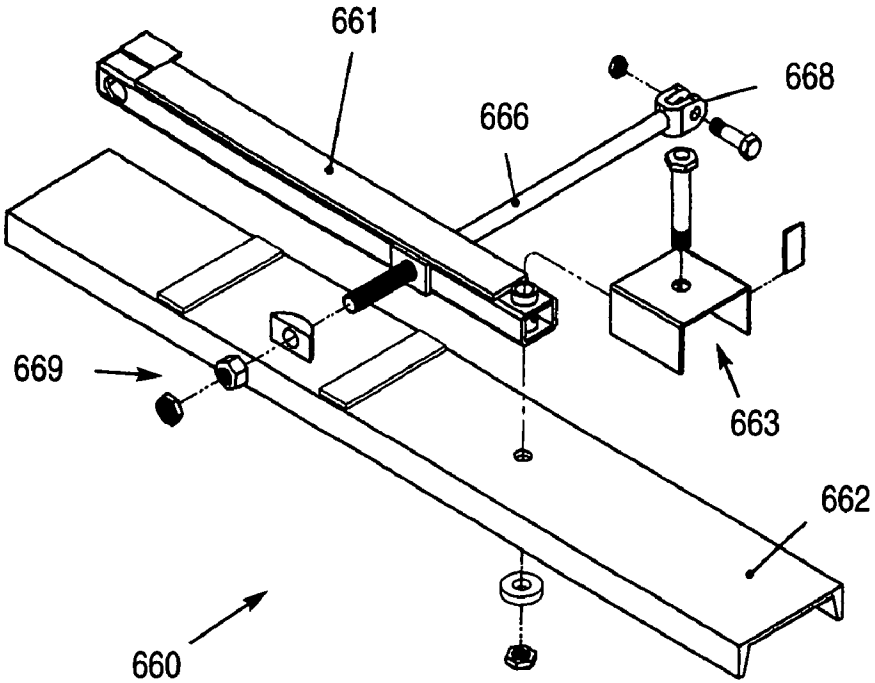
FIGURE #18

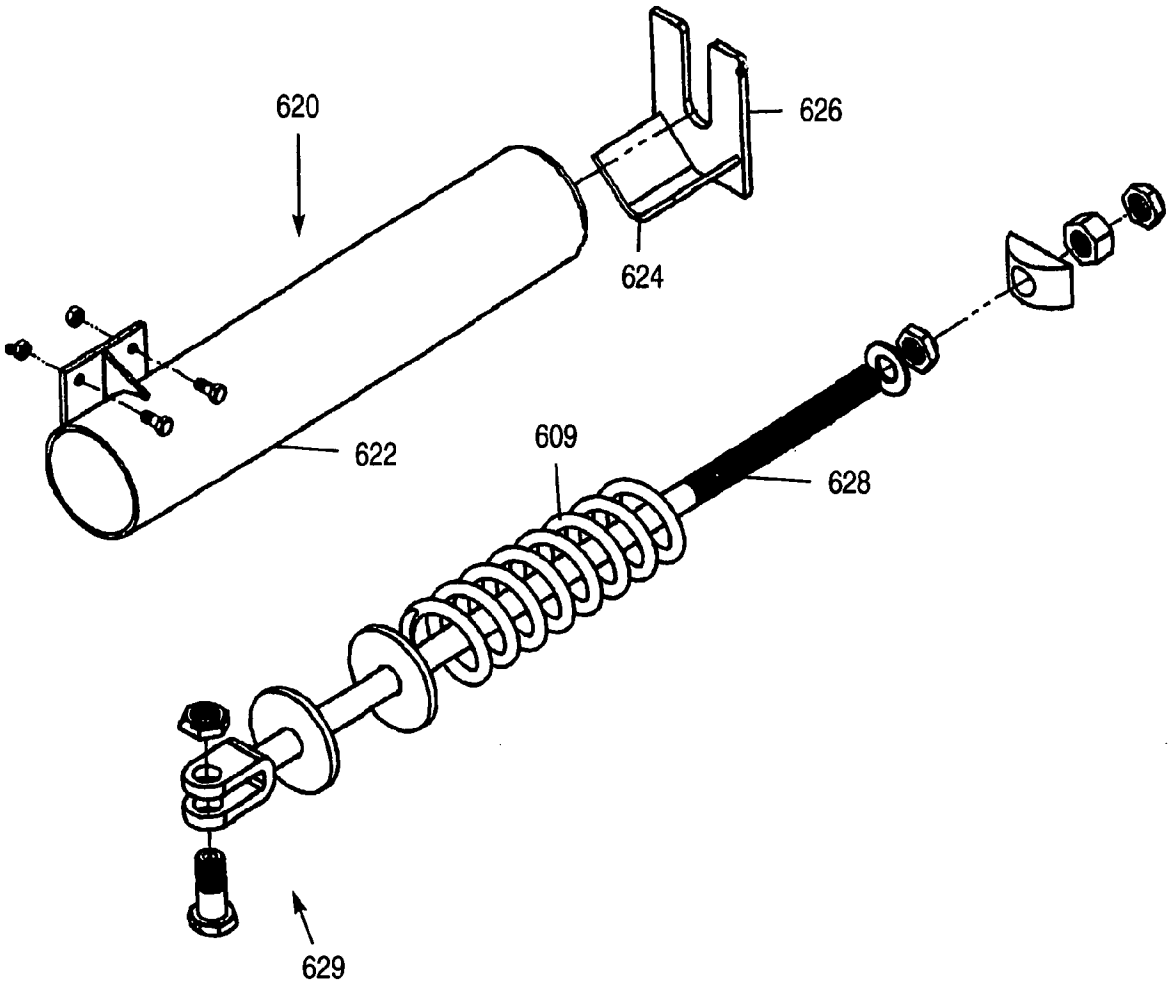
FIGURE #19

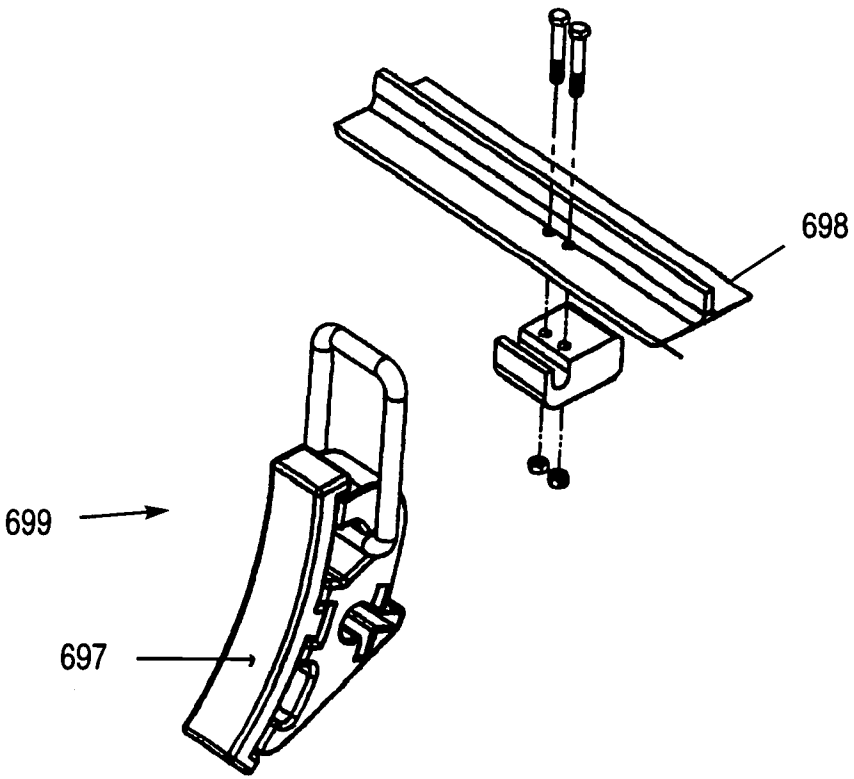
FIGURE #20

TRACK/RIGHT OF WAY MAINTENANCE AND REPAIR SYSTEM

BACKGROUND OF THE INVENTION

This invention relates to a railroad track and right of way maintenance and repair system, and more particularly, to a self-propelled vehicle capable of presenting a plurality of boom releasable implements for debris removal, pickup and transport along the rail tracks and right of way for dumping at a remote location.

Various devices have been proposed for maintaining and repairing a railroad track and its right of way including devices having rail cleaning nozzles, leaf removal nozzles, spray nozzles and the like. These devices were either coupled to the train itself or were designed to move along the rails.

Deficiencies were inherent with such devices as they were incapable of performing the multiplicity of track maintenance and repair tasks needed to be performed by various independent implements. Thus, such devices did not effectively address the removal, pickup and transport of the various types of debris found along and aside the tracks, inclusive of discarded ties, spikes, weeds, brush etc.

In response thereto, a track/right of way maintenance and repair system presents a self-propelled loader car with a boom thereon, the boom being pivotable and rotatable to a plurality of positions along and aside the track. An implement car coupled to the loader car, stores a plurality of implements for transport, with each implement being releasably attached to the boom according to the job at hand, such as a grappler/claw, brush-cutter, backhoe, and magnet for metal debris pickup. A refuse car is coupled to the loader car for debris storage, transport and deposit. The loader car contains a hydraulic system for a plurality of functions e.g., cab propulsion, braking, boom manipulation, cab tilt and implement power.

It is therefore a general object of this invention to provide self propelled track/right of way maintenance and repair system which can perform a multiplicity of debris removal tasks as well as debris pickup and transport.

A further object of this invention is to provide a system, as aforesaid, which presents a self-propelled loader car having a universal boom assembly.

Another object of this invention is to provide a system, as aforesaid, having an implement car and/or a refuse car, coupled to the self-propelled loader car.

A further object of this invention is to provide a system, as aforesaid, which has a hydraulic system for powering the various functions associated with the loader, implement and refuse cars.

A more particular object of this invention is to provide a system, as aforesaid, wherein the boom is rotatable and/or pivotable relative to the track to enhance debris removal and pickup therealong.

Another object of this invention is to provide a boom, as aforesaid, wherein the refuse car is moveable between debris loading and refuse dumping positions.

A particular object of this invention is to provide an operator cab on the loader car which is moveable through normal operating and transport profiles to enable the loader car to pass under bridges, viaducts or the like.

Another object of this invention is to provide a hydraulic braking system for the various cars which will engage the brakes upon a loss of hydraulic power.

Another particular object of this invention is to provide a boom assembly which provides hydraulic and/or electric power to the implements to be attached thereto.

Other advantages of this invention will become apparent from the following description taken in connection with the accompanying drawings, wherein is set forth by way of illustration and example, a now preferred embodiment of the present invention.

BRIEF DESCRIPTION OF THE DRAWINGS

FIG. 1 is a perspective view of the loader car and implement car of the track/right of way maintenance and repair system, the bed of the implement car being removed to enhance illustration;

FIG. 2 is a partial view of the loader car frame with the wheel axle assembly exploded therefrom, the cab and boom assemblies being removed therefrom to enhance illustration;

FIG. 3 is a partial view of the implement car with a portion of the axle assembly exploded therefrom;

FIG. 4 is another perspective view of the frame of the loader car with the cab and boom assemblies being removed to enhance illustration;

FIG. 5 is a view showing one form of the hydraulic motor and chain drive assembly for propelling the loader car;

FIG. 5A is a perspective view showing the hydraulic motor and chain drive assemblies in a preferred medial location on the loader car;

FIG. 6 is a side view showing the FIG. 5A loader car on an enlarged scale;

FIG. 7 is a front view primarily showing the hydraulic propulsion system for the loader car;

FIG. 8 is a top view showing the FIG. 5A loader car on an enlarged scale;

FIG. 9 is a view showing a portion of the turntable assembly for rotating the cab of the loader car and the pivotal mounting structure for the boom assembly;

FIG. 10 is a diagrammatic view of a portion of one form of the hydraulic system for loader car propulsion;

FIG. 11 is a diagrammatic layout of one form of the hydraulic system;

FIG. 12 is a perspective view of the jib of the boom assembly.

FIG. 13 is a view showing the grappler implement for attachment to the jib assembly;

FIG. 14 is a series of diagrammatic views showing the dumping actions of the refuse car;

FIG. 15 is a view showing the support frame for the operator cab;

FIG. 16 is a fragmentary front view of the operator cab;

FIG. 17 is a fragmentary side view of the operator cab; and

FIG. 18 is an exploded view of a swing arm assembly of a braking system;

FIG. 19 is an exploded view of the brake spring barrel of a braking system;

FIG. 20 is an exploded view of the brake pad hanger assembly of a braking system.

DETAILED DESCRIPTION

Turning more particularly to the drawings, FIG. 1 illustrates the loader car 1000 and the coupled 1100 implement 2000 of the new preferred embodiment of the track/right of way maintenance and repair system. FIG. 14 diagrammatically illustrates the refuse car 3000 which is coupled to the opposed end of the loader car 1000.

The loader car 1000 includes a main frame 200 designed to support a cab supporting platform 350 mounted to a turntable 300. Mounted atop the turntable 300 is a pivotable boom assembly 400. Operator control of the turntable 300 and boom assembly 400 pivots and rotates the boom assembly 400 relative to the frame 200. A hydraulic system includes a hydraulic motor 902 for propelling the loader car 1000 via a chain drive assembly 904 (FIG. 5) as well as various lines, valves, controls and the like to rotate the turntable 300, pivot the boom assembly 400, rotate and tilt the cab 500, operate the braking systems of the various cars 1000, 2000, 3000 and power the selectable implements releasably connected to the boom assembly 400 e.g., the grappler 1400 (FIG. 13).

The frame 200 includes an assembly of support beams and struts which present a generally rectangular frame moveable by a wheel axle assembly 250 (FIG. 2). Assembly 250 includes wheels 260 at the axle 262 ends which are spaced to engage the track rails. Front and rear brake assemblies 600 as to be subsequently described as provided.

Attached to the frame 200 in front of turntable 300 is the hydraulic motor 902 assembly for loader car 1000 propulsion. (It is noted that this assembly is preferably mounted to the frame 200 location as shown in FIGS. 5A, 6-9 as opposed to the rear side mount 9001 shown in FIGS. 1, 4). The assembly 902 includes a motor housing mounting plate 901 with cover 911 for the hydraulic motor 902. One form of the drive train is as shown in FIG. 5 wherein motor 902 presents a shaft 903 for engaging an upper sprocket 904. A triple chain 905 is wound about the upper 904 and lower 906 sprockets. The sprocket 906 presents a key 907 which engages to spline 265 along the axle 262 (FIG. 7). As shown in FIG. 2 a spline shaft 263 and hub axle adapter 265 may be used in the FIG. 1 side mount version. Accordingly, hydraulic operation of motor 902 rotates sprocket 904 which chain drives the sprocket 906 and axle 262 coupled thereto.

One form of the fluid flow for the motor 902 operation as shown in FIG. 10, in which hydraulic lines 907,909 are directed to motor 902 according to the direction of propulsion such lines extending from a fluid manifold 910'. FIG. 11 further shows a drive block 910 which directs pressurized fluid lines 907', 909' to motor 902. Fluid overflow is directed to reservoir 952 via line 915. It is understood that various flow connections may be used to direct flow to motor 902 according to whether a forward or reverse direction is required.

Mounted atop the frame 200 is a turntable assembly 300 for rotation of the cab assembly 500 and boom assembly 400 attached thereto. A pair of side riser plates 280 is attached to the frame 200 with horizontal support structure 282 extending therebetween. Atop structure 282 is a mounting plate 284 having a riser ring 286 thereon (FIG. 2). Atop ring 286 is mounted a lower bearing plate 288, with a lower filler plate 290 and stop plate 291 presenting an annular channel therein (FIG. 8).

As shown in FIG. 9 the turntable assembly further presents a plate 302 mounted atop lower bearing plate 288. The turntable presents a depending wall 292 with a toothed 305 aperture 304 therein. Upon placement of plate 302 atop plate 288, teeth 305 are spaced from teeth 295 which surround the circumference of lower plate 288. Atop the bearing turntable plate 302 is a boom mounting structure including a pair of vertical sidewalls 306, 308 with a vertical wall 307 extending therebetween.

The base plate 302 includes an aperture 310 for extension of a swing motor 320 driven gear box 312 therethrough such that the splined shaft 314 meshes with the spaced apart teeth 295, 305. Gear box 312 is driven by a hydraulic motor 320 coupled to the hydraulic system. Thus, the riser 292/plate 302 combination rotates relative to the lower bearing plate 288 upon delivery of fluid to motor 320. The delivery and return of hydraulic fluid via hydraulic lines, relative to motor 320, is left to the discretion of those skilled in the art ranging between a simple direct delivery system and lines 919, 921 directed to the swing motor 920 from an upstream manifold 925 provided with pressurized fluid via line 930 (FIG. 11).

Attached to the vertical walls 306, 308 on base plate 302 by welding or bolts is a horizontal platform 350 for supporting the hydraulic tank 952 and cab assembly 500 thereon. The hydraulic tank 952 and cab assembly 500 further function as a counterweight to the weight of the boom assembly 400 as subsequentially described. Accordingly, as the turntable 300 rotates, the platform 350 and structure thereon will travel with the turntable 300.

The cab assembly 500 includes a rectangular frame 510 secured to a raised corner of platform 350 (FIG. 15). The frame includes a pair of sidewalls 512, front wall 514 and rear wall 516. A hinge 518 attached to sidewall 512 supports a piston/cylinder 520 with the piston free end 522 attached to a bracket 524 extending from a front wall strut 534 of the main cab (FIG. 17).

Further attached to the sidewalls 512 are a pair of brackets 526 for the ends of a pivot rod 528 which extends through the bottom of slats 532 of the cab at the lower front edge 532 thereof.

The cab 500 has a bottom wall adapted to rest atop the cab frame 510. The front wall of cab 500 comprises the plurality of spaced vertical slats 532 which allows unimpaired vision but preclude large pieces of debris from entering the cab 500. The cab 500 includes a seat for the operator as well as operator controls for the various hydraulic systems e.g., shown in FIG. 11. The hydraulic system 900 includes means for extension and extraction of the piston 920. One form is as shown in FIG. 11 via lines 925, 927. As the piston arm 920 is retracted the cab is forwardly rotated about the rod 528 at its front edge 532. This tilting action presents a lower cab profile to allow the loader car to pass underneath bridges, viaducts, etc. during transport.

Attached to the turntable assembly 300 is boom assembly 400 including the main boom arm 420 and jib 450. The end of the main boom 420 is pivotally attached about pin 307 extending between the vertical sidewalls 306, 308 of the head assembly. Extending between the sidewalls 306, 308 and main boom arm 420 is a first piston/cylinder combination 922 for regulating the pivotal movement of the main boom arm 420. One end of the piston/cylinder 922 is attached between sidewalls 306, 308 by means of pin 309 extending through bracket 310. The opposed end of piston end is attached between depending walls 421 of the main boom 420.

Pivotally attached to the end of the main boom arm 420 about pin 452 is the jib 450 (FIG. 12). A lift piston/cylinder 952 combination extends between the main boom arm 420 and jib 450 to regulate pivotal movement therebetween. The end of jib 450 presents ears 460 for attachment to an implement upon extension of one or more mounting pins/nut combinations 462, 463 between the jib ears 460 and complimentary ears 1460 found on the selected implement such as the ears 1460 shown on the grappler assembly 1400 in FIG. 13.

Extending along the main boom 420 and jib 450 are a serious of hydraulic inlet 970 and return hoses 972 which present releasable couplings 973 so as to communicate with upstream hydraulic fluid hoses in communication with the reservoir 952. Couplings 974 at the opposed hose end connect with complementary hoses associated with the implement mounted at the end of the jib 450. These hoses provide hydraulic flow to the pistol/cylinder combinations 1420 shown in FIG. 14 so as to operate the grapple arms 1440. Additionally, such lines 970,972 can communicate with similar piston/cylinder combinations or hydraulic motors found in other implements so as to operate the same.

Also, as shown, in FIG. 12, an electrical line 480 may be extended from an onboard generator on the frame 200 along the main boom 420 and jib 450 so as to deliver current used for energization of a selected implement, e.g., a magnet assembly which is one implement that can be stored in the implement car 2000 and selectably mounted to the end of the jib 450.

In use, the various implements are stored in the implement car 2000 awaiting a releasable attachment to the end of the jib 450. (It is noted that the railroad tie floor of the implement car 2000 has been omitted for purposes of illustration but comprises a series of railroad ties extending between the side rails 2100).

Operation of the hydraulic system 900 enables the operator to rotate the turntable 300 and operate piston/cylinder combinations 922,952 so as to place the end of the jib 450 approximate the end of the selected implement such as the shown grappler assembly 1400. Upon attachment of the implement thereto, such as by extension of the pin through the ears 1460 of the grappler and the jib ears 460 the appropriate hydraulic lines 970, 972 are connected to the piston/cylinder combinations of the implement to as to provide hydraulic flow thereto. (In some cases the lines may be connected to a hydraulic motor found in the implement or the electric line 480 needs to be connected such as to a magnet assembly). The operator then rotates the turntable 300 and pivot the boom head assembly 400 so as to place the implement at an appropriate position along or aside the track so as to collect the desired refuse or otherwise power the implement e.g., as a brush cutter or back hoe. Upon powering the hydraulic motor 902, the loader car 1000 with the implement 2000 and refuse car 3000 coupled thereto, can be moved up and down along the track so that a plurality of appropriate implements can perform their functions along the length of track which is to be maintained. The operator can then manipulate the turntable and boom assemblies so as to deposit the grappled debris in the refuse car 3000. Ultimately, as diagrammatically shown in FIG. 14, the refuse car 3000 can be hydraulically tilted by operator controlled piston/cylinder combinations 990 so as to dump the collected refuse at the appropriate refuse site. As such, one crew can perform a plurality of functions which eliminates the need for one crew to remove the debris from along the rail, e.g. brush, and a second crew to return later to pickup and cart away the brush debris.

Various forms of the hydraulic system 900 can be designed so as to deliver and return hydraulic fluid to the various hydraulic motors and/or hydraulic piston/cylinder combinations. As shown in FIG. 11 the system may include hydraulic pumps 935 to deliver pressurized fluid to manifolds 910, 914, 915. Thus, the operator can selectably deliver fluid for the implement, e.g., the grappler, the turntable 300, main boom 420, jib 450, the braking systems 600 and the drive motor 902. It is understood that those skilled in the art can arrive at various fluid flow layouts to provide fluid delivery and control of fluid to the above assemblies. Thus, the invention is adapted for use with various hydraulic flow designs.

Hydraulically controlled braking assemblies 600 are associated with the wheels of cars 1000, 2000, 3000, as shown in FIG. 2, FIG. 3 and FIGS. 18-20. Included therein are hydraulic brake cylinders 610 which are coupled to a spring barrel assembly 620 as shown in FIG. 19. This assembly 620 includes a tube 622 supported by plate 624 and a guide shaft plate 626. Within the tube 622 is a spring 609 shaft 628 with one end coupled to the brake cylinder 610 and the other end coupled to the swing arm assembly 660' (FIG. 18).

The swing arm assemblies 660 are supported by channels 662 connected to frame 200 and includes a swing arm housing 661 pivotally mounted to channel 662 by pivot bracket 663. A linkage rod 666 passes through housing 661. One end of arm 666 is pivotally connected to housing by the pivot lug assembly 669. Likewise arm 666 presents a bracket assembly 668 for connection to the brake support structure 692.

Bracket 668 is connected to support structure 692 having struts 694 extending to a brake support beam 698. At the end of beam 698 are mounted the brake hanger assemblies 699 including pads 697 as shown in FIG. 20.

In operation a hydraulic fluid delivered to cylinder 610 moves the shaft 628 which is coupled to the swing arm assembly 660. This movement is transferred along linkage rod 666 and ultimately to beam 698 so as to direct the brake hanger assemblies 999 against the wheels 260.

As a fail safe, the absence of hydraulic fluid within brake cylinder 610 allows the spring 609 to return to its normal position. This spring action will likewise move the shaft 628, swing arm assemblies 660 and ultimately the brake assemblies 990 linked thereto against the wheels 260.

Again it is understood that such hydraulic brakes are operator controlled one such form being showing in the FIG. 11 layout at 960.

Although a now preferred embodiment of the invention has above been shown it is not limited thereto except insofar as such limitations are included in the following claims and allowable functional equivalents thereof.

What is claimed is:

1. A railroad track maintenance and repair system comprising:

a frame;

a plurality of track engageable wheels, said wheels configured to engage spaced-apart rails of a track, a rotation of said wheels moving said frame along said track rails;

a cab support frame fixed to said frame;

a cab on said cab support frame for a system operator, said cab including a floor and at least a wall upwardly extending from said floor, said floor at a first position atop said cab support frame for operator support during an operation of said system;

means for rotating said cab support frame and cab thereon about an imaginary vertical axis passing through said frame and track;

a segmented boom assembly comprising a main boom and a jib;

means for mounting said main boom to said frame in pivotal movement relative thereto, and in concurrent rotatable movement with said cab, said jib mounted to said boom in pivotal movement relative to said boom;

means for controlling pivotal movement of said boom;

means for controlling pivotal movement of said jib;

means for tilting said cab floor independent of said movement of said boom assembly from said first position atop said cab support frame to a second subsequent position approaching a vertical whereby said cab wall approaches a horizontal;

so as to present a reduced height profile of said cab at said subsequent position during at least a travel on said wheels guided along the track;

means on a free end of said jib adapted for releasably connecting a selectable maintenance implement thereon.

2. A system as claimed in claim 1 wherein said cab rotating means comprises:

a turntable mounted to said frame, said imaginary vertical axis passing through said turntable;

means for mounting said cab and support frame to said turntable;

means for rotating said turntable, said rotation concurrently moving said cab and support frame about said imaginary axis.

3. A system as claimed in claim 2 wherein said turntable rotating means comprises:

a base mounted to said frame;

a plate rotatably mounted to said base;

a drive train means coupling said base to said plate for rotating said plate relative to said base;

means for an operator powering of said drive train means whereby to selectively rotate said plate.

4. A system as claimed in claim 3 wherein said powering means comprises:

a motor coupled to said drive train means;

a hydraulic fluid reservoir;

means for communicating a flow of fluid from said reservoir to said motor to power said motor and said drive train means coupled thereto.

5. A system as claimed in claim 2 wherein said main boom mounting means comprises:

at least one upstanding wall on said turntable;

means for mounting an end of said main boom to said at least one wall in pivotal movement relative thereto.

6. A system as claimed in claim 5 wherein said control means of said boom comprises:

a hydraulic fluid reservoir;

a piston/cylinder combination extending between said at least one wall and said main boom;

means for communicating a regulated flow of fluid from said reservoir to said piston/cylinder combination whereby a movement of said piston pivots said main boom.

7. A system as claimed in claim 2 wherein said jib mounting means comprises:

means for mounting an end of said jib to an end of said main boom in pivotal movement relative thereto.

8. A system as claimed in claim 7 wherein said jib pivotal control means comprises:

a piston/cylinder combination extending between said end of said main boom and said jib;

means for communicating a regulated flow of said fluid from said reservoir to said piston/cylinder combination extending between said main boom and said jib, whereby a movement of said piston of said piston/cylinder combination extending between said main boom and jib moves said job in pivotal movement relative to said boom.

9. A system as claimed in claim 1 wherein said cab tilting means comprises:

a cab rod extending through said cab support frame and a portion of said cab;

a position/cylinder combination extending between said cab support frame and said cab;

a hydraulic fluid reservoir;

means for communicating a regulated flow of said fluid to said piston/cylinder combination extending between said cab support frame and said cab, whereby a movement of said piston of said piston/cylinder combination extending between said cab support frame and cab moves said cab about said cab rod between said first and second cab positions.

10. A system as claimed in claim 1 further comprising:

means for an operator controlled propulsion of said frame along the track.

11. A system as claimed in claim 10 wherein said propulsion means comprises:

a hydraulic motor;

a hydraulic fluid reservoir;

means for regulating a fluid flow from said reservoir to said motor to power the same;

means for coupling said motor to at least one of said wheels whereby a powering of said motor rotates said wheels.

12. A system as claimed in claim 11 wherein said coupling means comprises:

a first rotatable sprocket coupled to said hydraulic motor;

a second rotatable sprocket;

a chain wound about said sprockets;

means for coupling a rotation of one of said sprockets to at least said one of said wheels, said powering of said motor rotating said first sprocket and said second sprocket coupled thereto by said chain, where to rotate said at least one wheel coupled to said second sprocket.

13. A system as claimed in claim 1 further comprising:

a second frame coupled to said system frame;

a plurality of rail engageable wheels adapted for directing said second frame along the track, a movement of said system frame moving said second frame along the track;

a platform on said second frame adapted to store a plurality of debris removal implements thereon, each implement adapted for a releasable connection to said jib end.

14. A system as claimed in claim 1 further comprising:

a third frame coupled to said system frame;

a plurality of rail engageable wheels adapted for directing said third frame along the track, a movement of said system frame moving said third frame along the track;

a storage area on said third frame adapted to receive debris therein.

15. A system as claimed in claim 14 further comprising:

means for moving said storage area from a first position for said reception of the debris to a second position to discharge the debris from storage area.

16. The system as claimed in claim 1 wherein said cab support frame comprises:

a front wall;

a rear wall;

a pair of spaced-apart sidewalls extending between said front wall and rear wall, said floor supported atop said support frame walls at said first position, said titling means swinging said cab floor about one of said walls.

17. The system as claimed in claim 16 wherein said tilting means comprises:

a rod;

means for mounting said rod in extension along one of said walls of said cab support frame;

means for mounting said cab in movement about said rod;

a piston/cylinder combination extending between said cab support frame and said cab;

a hydraulic fluid reservoir;

means for communicating a fluid flow from said reservoir to said piston/cylinder combination extending between said cab support frame and said cab, a movement of said associated piston moves said cab in said movement about said rod between said first and second positions.

18. The system as claimed in claim 17 wherein said rod mounting means mounts said rod in extension along said front wall of said cab support frame, said movement of said cab tilts said cab relative to said front wall of said cab support frame.

19. The system as claimed in claim 16 wherein said tilting means comprises:

at least one bracket extending from a wall of said cab support frame;

a rod passing through said cab and said at least one bracket and spanning a wall of said support frame;

means for mounting said cab in movement about said rod;

a piston/cylinder combination extending between said at least one bracket and said cab;

a hydraulic fluid reservoir;

means for communicating a fluid flow from said reservoir to said piston/cylinder combination extending between said at least one bracket and said cab, a movement of said associated piston moving said cab about said rod between said first and second positions.

20. The system as claimed in claim 19 further comprising:

an opening in said cab wall;

a plurality of slats spanning said opening, said rod passing through said slats to provide said cab mounting means.

21. A railroad track maintenance device comprising:

a frame;

a plurality of track engageable wheels configured to engage rails of a track, a rotation of said wheels moving said frame along the track;

a cab on said frame for a system operator, said cab including a floor at a first horizontal position for user support during an operation of the system;

means for rotating said cab about an imaginary vertical axis passing through said frame and track;

a segmented boom assembly comprising a main boom arm and a jib;

means for mounting said main boom assembly to said frame in pivotal movement relative thereto and in rotatable movement about an imaginary axis passing through said frame and track;

means for controlling pivotal movement of said boom assembly;

means on a free end of said boom assembly for releasably connecting a selectable maintenance implement thereon;

means for pivoting said cab about a horizontal axis passing through said frame in pivotal movement independent of said boom assembly pivotal movement and movement of said frame, said pivotal movement swinging said floor about said horizontal axis from said first normal position to a second non-operating position approaching a vertical so as to present a reduced height profile of said cab at said second position during at least a travel on said wheels guided along the track for enabling said cab to pass under structure normally traversing the track.

22. A railroad track maintenance device comprising:

a frame;

a plurality of rail engageable wheels adapted for directing said frame along a track, a rotation of said wheels moving said frame along the track;

a cab having a floor for support of a system operator at a first normal operating position, said cab presenting a first height profile atop said frame, means for mounting said cab to said frame in rotation about an imaginary vertical axis passing through said frame and track;

means for mounting said cab floor relative to said frame to move said floor independent of said frame between said first position and a second position wherein said cab floor is canted relative to said frame so as to present a reduced height profile of said cab at said second position relative to said first height profile during at least a travel on said wheels guided along the track;

a segmented boom assembly comprising a main boom and a jib;

means for mounting said main boom to said frame in pivotal movement relative thereto and in concurrent rotatable movement with said cab;

means for mounting said jib to said boom in pivotal movement relative to said boom;

means for controlling pivotal movement of said boom;

means for controlling pivotal movement of said jib;

a free end of said jib adapted for releasably connecting a selectable maintenance implement thereon.

* * * * *

UNITED STATES PATENT AND TRADEMARK OFFICE

CERTIFICATE OF CORRECTION

PATENT NO. : 7,421,952 B2
APPLICATION NO. : 11/137274
DATED : September 9, 2008
INVENTOR(S) : Timothy Charles Taylor It is certified that error appears in the above-identified patent and that said Letters Patent is hereby corrected as shown below:

Column 7, lines 33 through 47, delete claims 7 and 8.

Column 8, line 24, delete "1" and substitute --13-- therefor.

Signed and Sealed this

Fourth Day of November, 2008

JON W. DUDAS
*Director of the United States Patent and Trademark Office*